US005884989A

United States Patent [19]

Truelove

[11] Patent Number: 5,884,989

[45] Date of Patent: Mar. 23, 1999

[54] HANDGUN SECURITY LOCK-BOX

[76] Inventor: Philip Truelove, 403 Hogle St., Weatherford, Tex. 76086

[21] Appl. No.: 18,946

[22] Filed: Feb. 5, 1998

[51] Int. Cl.[6] ..... A47B 95/02

[52] U.S. Cl. ..... 312/245; 248/551; 109/52

[58] Field of Search ..... 312/245; 248/551; 206/317; 70/63; 109/50, 51, 52

[56] References Cited

U.S. PATENT DOCUMENTS

| | | | |
|---|---|---|---|
| 2,465,057 | 3/1949 | Brandes | 109/51 |
| 2,561,129 | 7/1951 | McBride | 109/53 |
| 2,840,258 | 6/1958 | Caesar et al. | 248/551 |
| 3,146,739 | 9/1964 | Furman | 109/52 |
| 4,155,608 | 5/1979 | Orlewicz . | |
| 4,299,045 | 11/1981 | Cervantes . | |
| 4,987,836 | 1/1991 | Owen | 70/63 |
| 5,056,342 | 10/1991 | Prinz . | |
| 5,138,786 | 8/1992 | Fischer . | |

OTHER PUBLICATIONS

Lewcor Gun Protector Security Case, Mounting Instructions Lewcor, Oceanside, CA., 1997.

Lewcor Security Case Model No. 9407 & 9410, Product Brochure, Lewcor, Oceanside, CA., 1997.

The Handgun Box, Product Brochure, R&D Enterprises, Phelan, CA., 1997.

Drawer Safe, Product Brochure, Palmer Security Products, Chicago, IL., 1997.

*Primary Examiner*—Peter M. Cuomo
*Assistant Examiner*—Gerald A. Anderson
*Attorney, Agent, or Firm*—Stephan R. Greiner

[57] ABSTRACT

A lock-box for safely storing a handgun. The lock-box includes a receptacle having an opening at one end thereof and a locking door with a flange for closing the opening. A pair of mounting brackets are secured to each of the opposed sides of the receptacle. The mounting brackets are adapted for sliding engagement with a mounting plate which may be attached by threaded fasteners to a supporting surface. When a pair of mounting brackets are slid fully over the mounting plate, a portion of the mounting plate will remain adjacent the opening for positioning between the flange and the receptacle to prevent the removal of the receptacle from the mounting plate while the door is locked. Because the mounting bracket pairs are on the opposite sides of the receptacle, the lock-box can be flip-flopped to suit the needs of a user.

13 Claims, 2 Drawing Sheets

HANDGUN SECURITY LOCK-BOX

FIELD OF THE INVENTION

The present invention relates generally to firearms and, more particularly, to receptacles therefor.

BACKGROUND OF THE INVENTION

Each year, about 1,500 children in the United States are rushed to hospital emergency rooms with accidental gunshot injuries. Nearly 200 children died from such wounds in 1994. Surprisingly, experts continue to suggest that handgun owners should not use trigger locks on handguns they keep loaded for protection.

In an effort to provide a handgun owner with quick access to a handgun, yet prevent others from gaining such access, handgun safes have been proposed. These safes generally include small receptacles for receiving one or more handguns. Because of their size, handgun safes are easily carried off by children, thieves and others unless such are mounted upon immovable objects.

The known mounting mechanisms for handgun safes are complex in construction and cumbersome to use. One particular shortcoming with these mechanisms is that they do not provide a user with the ability to position the safe in a standard orientation when it is alternatively mounted from above or below as would be the case if, for example, the safe was temporarily transferred from the underside of a bed frame to the floorboard of an automobile. Failure to maintain a single orientation for the safe makes manipulation of the safe's lock difficult in emergency situations when examining it may not be possible.

SUMMARY OF THE INVENTION

In light of the problems associated with the known handgun safes, it is a principal object of the invention to provide a lock-box for handguns, ammunition and other valuables that can be easily and removably mounted upon a variety of supporting surfaces. Such supporting surfaces may include: the undersurface of a bed frame, a closet wall, or an automobile floorboard, all of which make the contents of the lock-box readily accessible for use in emergencies.

It is a further object of the invention to provide a lock-box of the type described with pry-resistant mounting means.

It is another object of the invention to provide a handgun security lock-box which can be mounted and used in any desired orientation. Nonetheless, the inventive lock-box can be suspended from above or supported from below in a single orientation for ease of opening.

Still another object of the invention is to provide a handgun security lock-box that is small in size and is easily hidden in an out-of-sight location.

It is an object of the invention to provide improved elements and arrangements thereof in a handgun security lock-box which is lightweight in construction, inexpensive in manufacture and fully effective in use.

Briefly, the lock-box in accordance with this invention achieves the intended objects by featuring a receptacle having an interior cavity and an opening thereto. A locking door covers the opening and includes a flange which extends over the receptacle when the door is closed. At least one pair of mounting brackets are secured to the receptacle. Each of the mounting brackets includes a lateral fin and a retaining flange projecting from the lateral fin toward the opening. The apertured, central portion of a mounting plate is adapted for positioning between the mounting brackets. A pair of opposed, arm portions extend outwardly from the central portion and are adapted for positioning between the retaining flanges and the receptacle. A pair of finger portions are secured to the arm portions and extend toward the opening. The finger portions are adapted for positioning between the flange and the receptacle when the arm portions are abutting the lateral fins.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
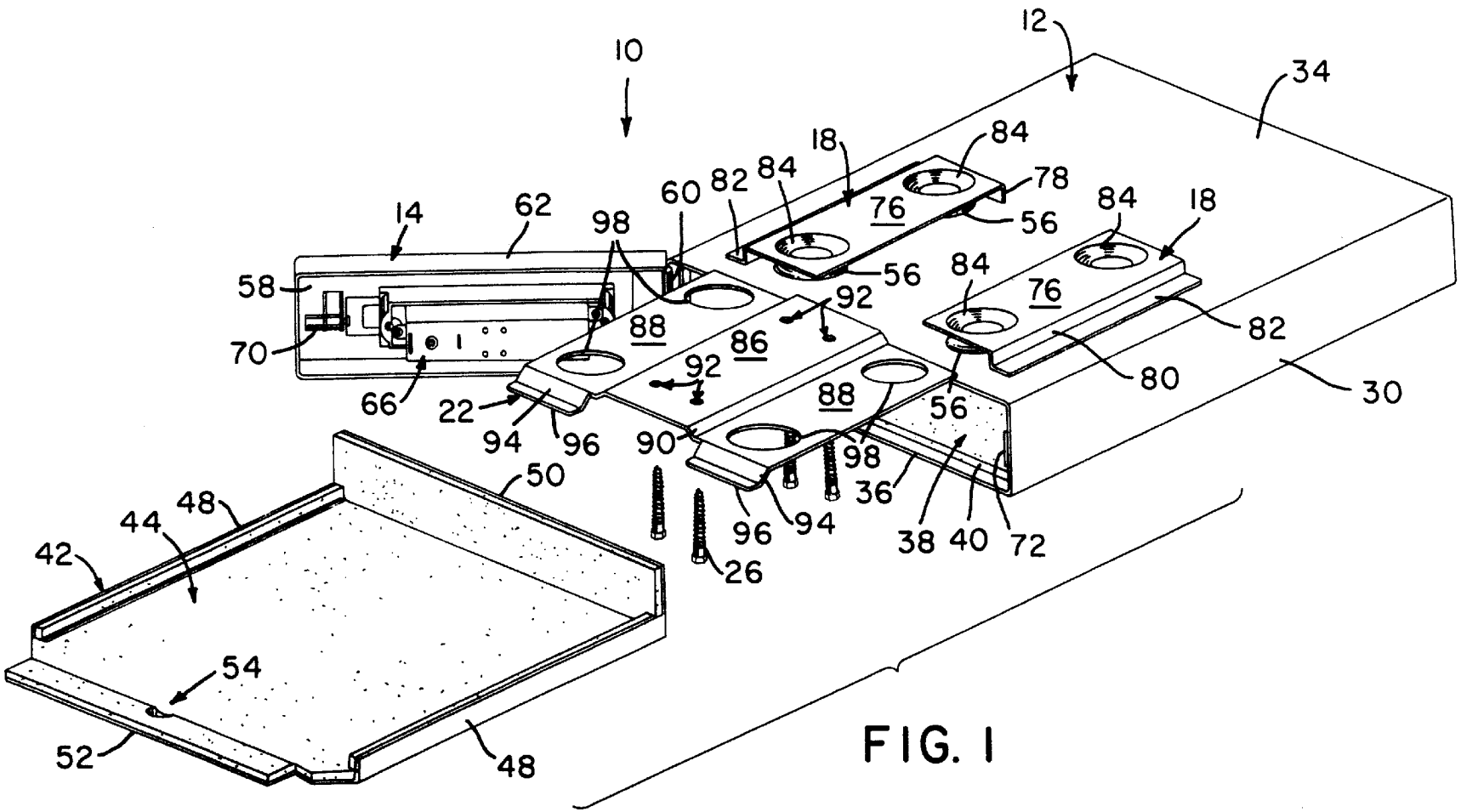
FIG. 1 is an exploded perspective view of a handgun security lock-box in accordance with the present invention.
Figure 2:
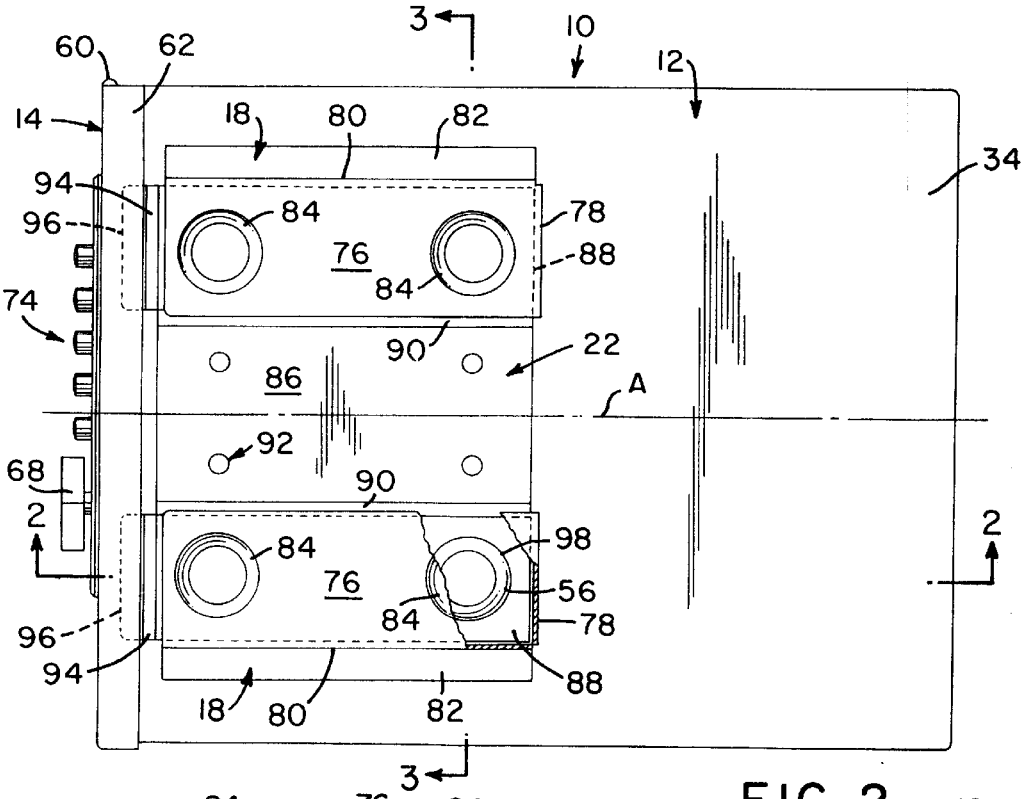
FIG. 2 is a top view of the lock-box of FIG. 1, with portions broken away to reveal details thereof.

Referring now to the FIGS., a handgun security lock-box in accordance with the present invention is shown at 10. The lock-box 10 includes a receptacle 12 having a locking door 14 for controlled access to the receptacle's interior cavity 16. Adjacent the door 14, two pairs of mounting brackets 18 and 20 are secured to the exterior of the receptacle 12. The brackets 18 and 20 are alternatively adapted for sliding engagement with a mounting plate 22 which is rigidly attached to a supporting surface 24 by means of threaded fasteners 26. Upon locking the door 14, the mounting plate 22 may be trapped within the brackets 18 or 20 to prevent unauthorized movement of the receptacle 12.

The receptacle 12 is a generally rectangular box formed from metallic sheeting and dimensioned to retain one or more handguns (not shown) within its interior cavity 16. The receptacle 12 includes: a rear wall 28, horizontally-spaced, side walls 30 and 32 extending forwardly from the rear wall 28, and vertically-spaced, top and bottom walls 34 and 36 connecting the side walls 30 and 32 and extending forwardly from the rear wall 28. The receptacle 12 has an opening 38 in its front end for access to the interior cavity 16 which is preferably lined with a foam padding 40 to protect items placed within the interior cavity.

To permit quick access to items placed within the interior cavity 16, the lock-box 10 is provided with a sliding tray 42. The tray 42 is formed from metallic sheeting and is lined with protective foam padding 44. The tray 42 includes: a bottom wall 46, side walls 48 extending upwardly from the bottom wall 44, a rear wall 50 with a height greater than that of the side walls 48 and extending upwardly from the bottom wall 46, and a front lip 52 extending upwardly from the bottom wall 46. The lip 52 is provided with a hole 54 for grasping by the finger of a user.

Adjacent the opening 38, four projections 56 protrude slightly from both the top wall 34 and the bottom wall 36 of the receptacle 12. The projections 56 are arranged in pairs on opposite sides of the receptacle centerline A and are equidistantly spaced therefrom. The projections 56 are formed by stamping or otherwise and are preferably shaped like frustums, i.e., forms left by cutting off the top portion of a cone with a plane parallel to the cone's base.

Figure 3:
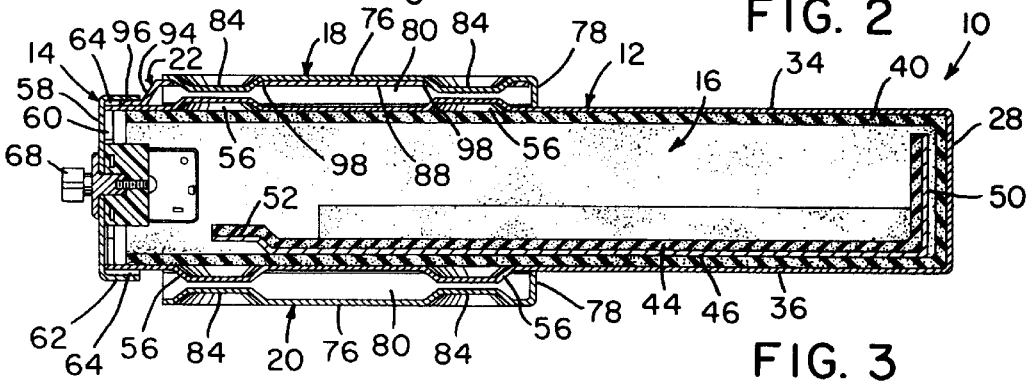
FIG. 3 is a cross-sectional view taken on line 2—2 of FIG. 2.

Like the receptacle 12, the door 14 is formed from metallic sheeting and is shaped to cover the opening 38 when closed. The door 14 includes a front plate 58 secured by a hinge 60 to the side wall 32 of the receptacle 12. Extending rearwardly from the front plate 58 is a peripheral flange 62. As shown in FIG. 3, the flange 62 is spaced from both the top wall 34 and the bottom wall 36 of the receptacle 12 so that slots 64 are provided therebetween.

Secured to the front plate 58 of the door 14 is a combination lock 66 of the type made by Simplex Access Controls of North Carolina. The lock 66 includes a knob 68 which extends outwardly from the front plate 58 which can be turned counterclockwise to extend a bolt 70 to catch on the projection 72 so as to lock the door 14. Unlocking the door 14 is accomplished by pressing the correct sequence of push buttons 74 adjacent the knob 68 and then turning the knob clockwise to retract the bolt 70.

Figure 4:
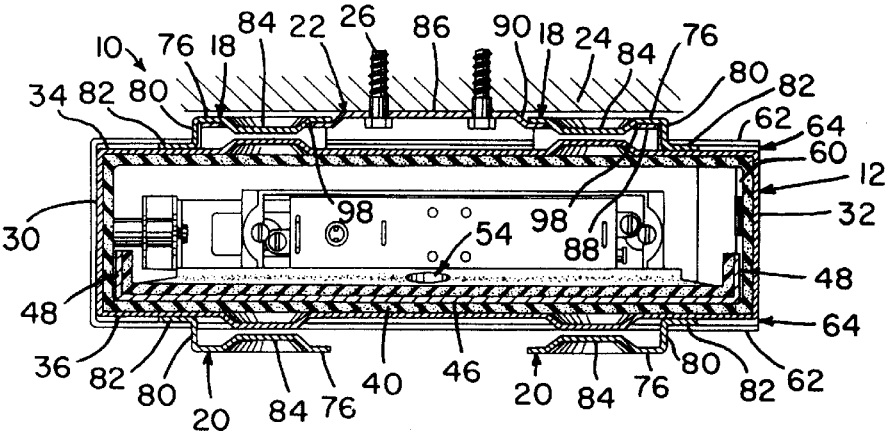
FIG. 4 is a cross-sectional view taken on line 3—3 of FIG. 2.

The brackets 18 and 20 are each integrally formed from metallic sheeting. Each of the brackets 18 and 20 includes a rectangular, retaining flange 76 with a lateral fin 78 extending at right angles from the rear edge thereof and an adjacent, longitudinal fin 80 extending at right angles from a side edge thereof. A mounting flange 82 extends at right angles from the base of each longitudinal fin 80. As shown in FIG. 4, the retaining flange 76 and the mounting flange 82 extend from opposite sides of the longitudinal fin 80 so as to provide the brackets 18 and 20 with S-shaped cross sections.

Each of the retaining flanges 76 is provided with a pair of frustum-shaped projections 84 adapted for alignment with one pair of projections 56 on the receptacle 12. The projections 84 project outwardly from each retaining flange 76 toward the receptacle 12. Preferably, the projections 56 and 84 have a combined height adequate to permit the mounting plate 22 to pass therebetween.

The brackets 18 are secured to the receptacle 12 by respectively welding the lateral fin 78 and mounting flange 82 of each to the top wall 34. Welding permanently positions the brackets 18 so that their retaining flanges 76 extend forwardly from the ends of the fins 78 toward the opening 38 in a common plane parallel to the top wall 34. Welding also permanently retains the projections 84 in axial alignment with the projections 56 of the top wall 34.

The brackets 20 are similarly welded to the bottom wall 36 of the receptacle 12. Thus, the retaining flanges 76 of brackets 20 are secured in a spaced, parallel relationship to the bottom wall 36. Likewise, the projections 84 of the brackets 20 are aligned with the projections 56 of the bottom wall 36.

The mounting plate 22 is integrally formed from metallic sheeting and includes a central portion 86 having a pair of arm portions 88 secured to the opposite sides thereof by downwardly-sloping shoulder portions 90. As shown, the central portion 86 is sized to alternately fit between the retaining flanges 76 of the brackets 18 or 20 and includes apertures 92 for the passage of threaded fasteners 26. The arm portions 88, however, are sized to slide snugly between the axially aligned projections 56 and 84 as well as abut the fins 78 and 80 of the brackets 18 and 20.

Extending forwardly from the front of each arm portion 88 is a downwardly-sloping wrist portion 94 which terminates in a finger portion 96. The finger portions 96 are adapted to snugly fit within either of the slots 64 when the door 14 is closed. Locking the door 14 with the finger portions 96 located in either of the slots 64 prevents unauthorized movement of the receptacle 12 away from the mounting plate 22.

To further discourage unauthorized movement of the receptacle 12, each of the arm portions 88 of the mounting plate 22 is provided with a pair of locking apertures 98. The apertures 98 are adapted to snugly encircle the projections 56 or 84 when the receptacle 12 is either pushed toward, or pulled from, the mounting plate 22 and supporting surface 24. In either case, the projections 56 or 84 act as lugs inserted into the mounting plate 22 to prevent sliding movement of the receptacle 12 relative to the mounting plate.

It should be noted that the finger portions 96, arm portions 88 and central portion 86 are disposed in parallel, vertically-spaced planes. The preferred vertical displacement of the central portion 86 relative to the arm portions 88 permits the central portion 86 to move freely between the brackets 18 or 20 without the retaining flanges 76 binding against supporting surface 24. Further, such displacement spaces the heads of threaded fasteners 26 away from the top wall 34 of the receptacle 12.

Use of the lock-box 10 is uncomplicated. First, the mounting plate 22 is secured with threaded fasteners 26 to a suitable supporting surface 24. Next, the door 14 is opened and the brackets 18 or 20 are drawn over the arm portions 88 of the mounting plate 22. The tray 42 is now pulled from the cavity 16 and filled with such items as a handgun. After repositioning the tray 42, the door 14 is closed and locked. When access to the items on the tray 42 is required, the lock 42 is simply unlocked and the door 14 is opened.

A user may need to secure the receptacle 12 to the underside of a bed to hold a handgun for personal protection while at home and also to secure the receptacle 12 to the floorboard of an automobile to safely transport the handgun to a firing range. Such a need is easily accommodated by securing separate mounting plates 22 to the bed frame and floorboard. The mounting brackets 18 and 20 permit the push buttons 74 to always be oriented in a standard position regardless of whether the receptacle 12 is suspended from above, or supported from below, by the mounting plate 22. Consistent orientation of the push buttons 74 permits a user to easily memorize the correct sequence for pressing the push buttons 74 to unlock the lock 66 and later to repeat the sequence without looking at the push buttons themselves as might be required in the dark.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

I claim:

1. A handgun security lock-box, comprising:

a receptacle having an interior cavity and an opening communicating with said interior cavity;

a door for selectively covering said opening, said door including:

a plate, dimensioned to cover said opening, hingedly secured to said receptacle;

a flange projecting from said plate, said flange being adapted to extend over said receptacle when said plate is covering said opening; and, a lock secured to said plate for selectively fastening said plate over said opening;

a pair of mounting brackets secured to said receptacle in a spaced apart relationship, each of said mounting brackets including:

a lateral fin projecting from said receptacle; and, a retaining flange projecting from said lateral fin toward said opening and being spaced from said receptacle; and, a mounting plate for selectively attaching said receptacle to a supporting surface, said mounting plate including:

a central portion adapted for positioning between said mounting brackets, said central portion having a plurality of spaced apart apertures each dimensioned to receive a connector therethrough;

a pair of opposed, arm portions secured to said central portion and extending, respectively, outward from said central portion, said arm portions being adapted for positioning between said retaining flanges and said receptacle and for abutting said lateral fins; and, a pair of finger portions each being respectively secured to one of said arm portions and extending therefrom toward said opening, said finger portions being adapted for positioning between said flange and said receptacle when said arm portions are abutting said lateral fins and said plate is covering said opening.

2. The lock-box according to claim 1 wherein each of said arm portions is provided with a locking aperture and each said retaining flange includes a first projection for snug positioning within said locking aperture.

3. The lock-box according to claim 2 wherein said receptacle includes a plurality of second pojections respectively axially aligned with each said first projection.

4. The lock-box according to claim 3 wherein each of said first and second projections is a frustum.

5. The lock-box according to claim 1 further comprising a tray slidably positioned within said interior cavity and removable through said opening.

6. A lock-box, comprising:

a hollow receptacle having an open front end and including:

a rear wall;

a pair of horizontally-spaced, side walls extending forwardly from said rear wall; and, a pair of vertically-spaced, top and bottom walls connecting said side walls and extending forwardly from said rear wall;

a door for selectively covering said open front end, said door including:

a plate, dimensioned to cover said open front end, hingedly secured to said receptacle;

a flange projecting rearwardly from said plate, said flange being adapted to extend over said top wall and said bottom wall when said plate is covering said open front end; and, a lock secured to said plate for selectively fastening said plate over said open front end;

a pair of first mounting brackets secured to said top wall in a spaced apart relationship, each of said first mounting brackets including:

a lateral fin projecting upward from said top wall; and, a retaining flange projecting from said lateral fin toward said opening and being spaced from said top wall; and, a mounting plate for selectively attaching said receptacle to a supporting surface, said mounting plate including:

a central portion adapted for positioning between said first mounting brackets, said central portion having a plurality of spaced apart apertures each dimensioned to receive a connector therethrough;

a pair of opposed, arm portions secured to said central portion and extending, respectively, outward from said central portion, said arm portions being adapted for positioning between said retaining flanges and said top wall and for abutting said lateral fins; and, a pair of finger portions each being respectively secured to one of said arm portions and extending therefrom toward said open front end, said finger portions being adapted for positioning between said flange and said top walls when said arm portions are abutting said lateral fins and said plate is covering said open front end.

7. The lock-box according to claim 6 further comprising:

a pair of second mounting brackets secured to said bottom wall in a spaced apart relationship, each of said second mounting brackets including:

a lateral fin projecting downward from said bottom wall; and, a retaining flange projecting from said lateral fin toward said opening and being spaced from said bottom wall; and, said mounting plate being adapted for alternative engagement with either said first mounting brackets or said second mounting brackets.

8. The lock-box according to claim 7 wherein each of said arm portions is provided with a locking aperture and each said retaining flange includes a first projection for snug positioning within said locking aperture.

9. The lock-box according to claim 8 wherein said top wall and said bottom wall include a plurality of second projections respectively axially aligned with each said first projection.

10. The lock-box according to claim 9 wherein each of said first and second projections is a frustum.

11. The lock-box according to claim 6 further comprising a tray slidably positioned within said interior cavity and removable through said opening.

12. A lock-box, comprising:

a hollow receptacle having an open front end and including:

a rear wall;

a pair of horizontally-spaced, side walls extending forwardly from said rear wall; and, a pair of vertically-spaced, top and bottom walls connecting said side walls and extending forwardly from said rear wall;

a door for selectively covering said open front end, said door including:

a plate, dimensioned to cover said open front end, hingedly secured to said receptacle;

a flange projecting rearwardly from said plate, said flange being adapted to extend over said top wall and said bottom wall when said plate is covering said open front end; and, a combination lock secured to said plate for selectively fastening said plate over said open front end;

a pair of first mounting brackets secured to said top wall in a spaced apart relationship, each of said first mounting brackets including:

a first lateral fin projecting upward from said top wall; and, a first retaining flange projecting from said first lateral fin toward said opening and being spaced from said top wall, said first retaining flange including a first projection projecting therefrom toward said top wall;

a pair of second mounting brackets secured to said bottom wall in a spaced apart relationship, each of said second mounting brackets including:

a second lateral fin projecting downward from said bottom wall; and, a second retaining flange projecting from said second lateral fin toward said opening and being spaced from said bottom wall, said second retaining flange including a second projection projecting therefrom toward said bottom wall; and, a mounting plate being adapted for alternative engagement with either said first mounting brackets or said second mounting brackets for selectively attaching said receptacle to a supporting surface, said mounting plate including:

a central portion adapted for positioning between said first mounting brackets, said central portion having a plurality of spaced apart apertures each dimensioned to receive a connector therethrough;

a pair of opposed, arm portions secured to said central portion and extending, respectively, outward from said central portion, said arm portions being adapted for positioning between said retaining flanges and said top wall and for abutting said lateral fins, each of said arm portions including a locking aperture within which may be alternately positioned one of said first projections or one of said second projections; and, a pair of finger portions each being respectively secured to one of said arm portions and extending therefrom toward said open front end, said finger portions being adapted for positioning between said flange and said top walls when said arm portions are abutting said lateral fins and said plate is covering said open front end.

13. The lock-box according to claim 12 further comprising a tray slidably positioned within said interior cavity and removable through said opening.

* * * * *